US007784564B2

(12) United States Patent
Iskander et al.

(10) Patent No.: US 7,784,564 B2
(45) Date of Patent: Aug. 31, 2010

(54) METHOD TO PERFORM OPERATIONS IN A WELLBORE USING DOWNHOLE TOOLS HAVING MOVABLE SECTIONS

(75) Inventors: Sami Iskander, Houston, TX (US); Ricardo Vasques, Sugar Land, TX (US); Tribor Rakela, Caracas (VE)

(73) Assignee: Schlumberger Technology Corporation, Sugar Land, TX (US)

( * ) Notice: Subject to any disclaimer, the term of this patent is extended or adjusted under 35 U.S.C. 154(b) by 90 days.

(21) Appl. No.: 11/782,819

(22) Filed: Jul. 25, 2007

(65) Prior Publication Data

US 2009/0025941 A1 Jan. 29, 2009

(51) Int. Cl.
*E21B 23/00* (2006.01)
*E21B 31/00* (2006.01)

(52) U.S. Cl. ..... 175/20; 175/58; 166/264

(58) Field of Classification Search ..... 166/192, 166/381, 98, 250.01, 254.2; 175/58
See application file for complete search history.

(56) References Cited

U.S. PATENT DOCUMENTS 1,430,473 A * 9/1922 Stoll ..... 175/98
3,329,209 A 7/1967 Kisling
4,600,059 A 7/1986 Eggleston et al.
6,003,606 A 12/1999 Moore et al.
6,230,813 B1 5/2001 Moore et al.
6,286,592 B1 9/2001 Moore et al.
6,601,652 B1 8/2003 Moore et al.
6,655,458 B2 * 12/2003 Kurkjian et al. ..... 166/254.2
6,758,279 B2 7/2004 Moore et al.
7,059,417 B2 6/2006 Moore et al.
7,082,994 B2 8/2006 Frost, Jr. et al.
7,195,063 B2 3/2007 Nogueira et al.
2004/0140102 A1 * 7/2004 Bakke ..... 166/381

* cited by examiner

*Primary Examiner*—Giovanna C Wright
*Assistant Examiner*—James G Sayre
(74) *Attorney, Agent, or Firm*—Dave R. Hofman

(57) ABSTRACT

Apparatus and methods to perform operations in a wellbore using downhole tools having movable sections are described. In one described example, a downhole tool for use in a wellbore includes a first extendable anchor to contact a wall of the wellbore to fix the tool at a location in the wellbore. The downhole tool also includes a first tool of the downhole tool to perform a first operation at the location in the wellbore, and a second tool of the downhole tool spaced from the first tool and to perform a second operation. Additionally, the downhole tool includes an extendable member to move the second tool to the location while the anchor is in contact with the wall of the wellbore to perform the second operation after the first operation.

16 Claims, 14 Drawing Sheets

METHOD TO PERFORM OPERATIONS IN A WELLBORE USING DOWNHOLE TOOLS HAVING MOVABLE SECTIONS

FIELD OF THE DISCLOSURE

The present disclosure relates generally to downhole tools and, more particularly, apparatus and methods to perform operations in a wellbore using downhole tools having movable sections.

BACKGROUND

Downhole tools such as, for example, wirleline, coiled tubing, and drill string deployed tools, are commonly used in a wellbore to sample fluid from a subterranean formation through which the wellbore passes. Such downhole tools may alternatively or additionally be used to measure one or more parameters or properties associated with a wellbore and/or formation such as, for example, temperature(s), pressure(s), rock properties, etc. at various depths.

The depth at which a downhole tool is located within a wellbore may be crucial. For example, when sampling a formation, it may be important to control the depth of the sampling tool so that a sampling probe of the sampling tool is relatively precisely aligned with the formation or a portion of the formation. Various known techniques such flagging, which is used in the case where a downhole tool is deployed via a wireline, and gamma ray correlation techniques, which may be used with drill string, wireline, and coiled tubing deployed tools, can be used to control the depth at which a downhole tool is located within a wellbore. However, in the case where multiple downhole tools are used to accomplish a series of operations within a wellbore and/or in connection with a formation, it can prove difficult to align a second downhole tool at a given location (e.g., a particular depth and/or orientation) within a wellbore to perform a second operation (e.g., a sampling operation) after a first operation (e.g., injection of a fluid into the formation) has been performed by a first downhole tool at that location.

SUMMARY

In one described example, a downhole tool for use in a wellbore includes a first tool to perform a first operation and a second tool to perform a second operation. The downhole tool also includes a first section including an extendable anchor to extend to contact a wall of the wellbore to fix the first section of the downhole tool at a location in the wellbore, and a second section movable relative to the first section along a longitudinal axis of the downhole tool while the first section is fixed at the location by the extendable anchor to move at least one of the first tool or the second tool.

In another described example, a downhole tool for use in a wellbore includes a first extendable anchor to contact a wall of the wellbore to fix the tool at a location in the wellbore. The downhole tool also includes a first tool of the downhole tool to perform a first operation at the location in the wellbore, and a second tool of the downhole tool spaced from the first tool and to perform a second operation. Additionally, the downhole tool includes an extendable member to move the second tool to the location while the anchor is in contact with the wall of the wellbore to perform the second operation after the first operation.

In another described example, a method of performing operations in a wellbore involves lowering a downhole tool to a location in the wellbore, anchoring a first section of the downhole tool to a wall of the wellbore, and performing a first operation at the location. The method also involves moving a second section of the downhole tool away from the first section along a longitudinal axis of the downhole tool and performing a second operating via the second section at the location.

In yet another described example, a method of performing an operation in a wellbore involves lowering a downhole tool in the wellbore, anchoring a first section of the downhole tool to a wall of the wellbore, moving a second section of the downhole tool away from the first section along a longitudinal axis of the downhole tool, and performing an operation in the wellbore via the second section.

DETAILED DESCRIPTION

Figure 1A:
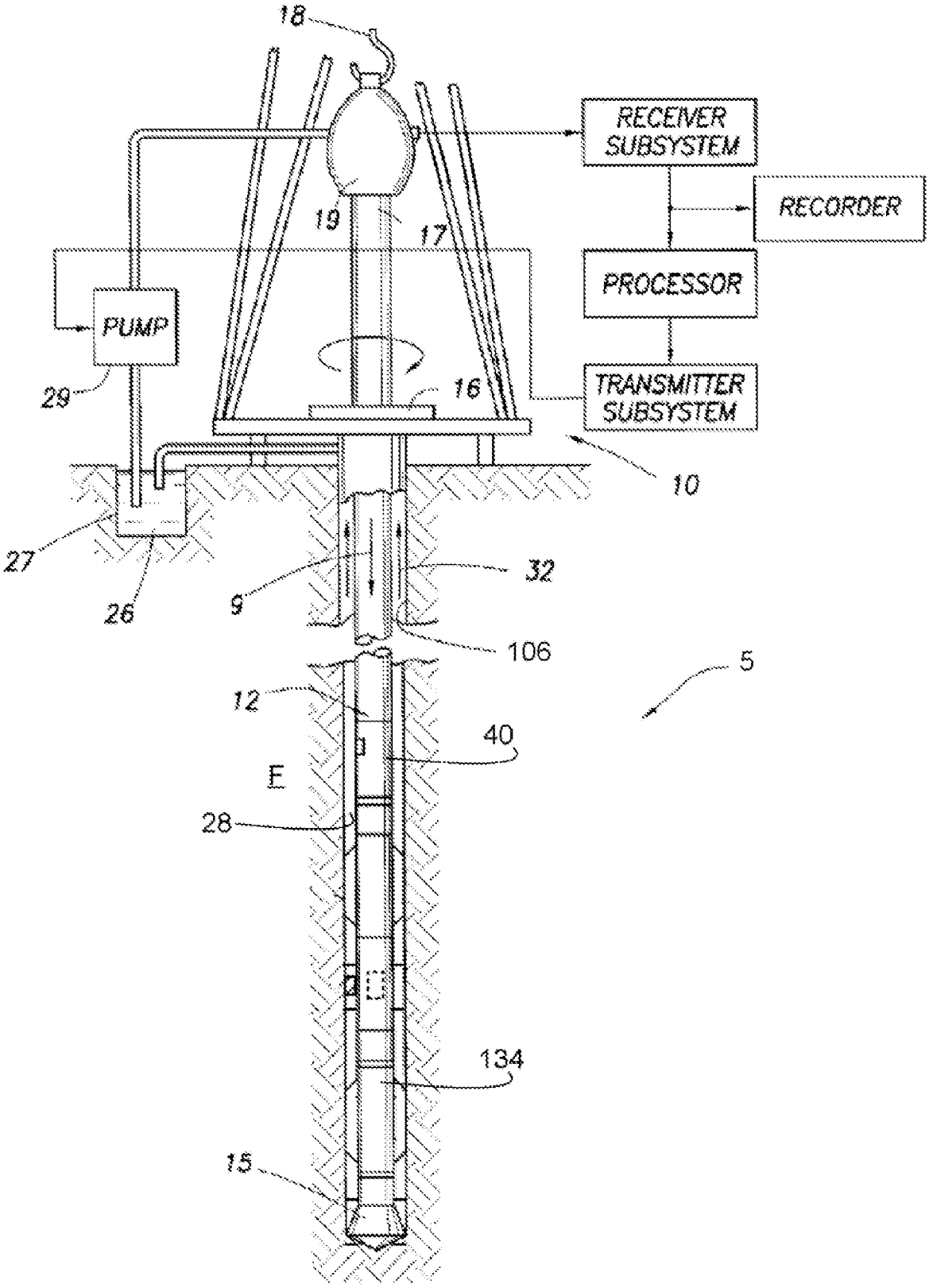
FIG. 1A depicts an example drilling rig and wellbore.

In general the example bottom hole assemblies or downhole tools described herein may be used to perform one or more operations at one or more precisely controlled depths or locations within a wellbore. Multiple or a sequence of operations using multiple different tool components of a downhole tool may be performed at substantially a single location or depth within the wellbore and/or a single type of operation may be performed at multiple precisely controlled location intervals, depths, and/or orientations within the wellbore. In contrast to known downhole tools, the example downhole tools described herein include one or more sections, each of which may include one or more tools or devices to perform one or more wellbore operations. The one or more sections of each of the example downhole tools may be movable (e.g., extendable, retractable, etc.) relatively precise distances along a longitudinal axis of the downhole tool. In this manner, the individual tools or devices of the downhole tool can be more precisely positioned at depths or locations within a wellbore than would otherwise be possible using conventional techniques such as, for example, flagging a wireline, using gamma ray correlation techniques, etc. Thus, the example downhole tools described herein enable testing operations, sampling operations, completion operations, etc. to be performed more accurately to provide results that are more accurate, repeatable, and reliable than possible with conventional techniques.

In some of the example downhole tools described herein, the downhole tool includes a first section having an extendable anchor or other member(s) to contact a wall of a wellbore to fix the first section of the downhole tool at a given location (e.g., depth and/or orientation) in the wellbore. A second section of the downhole tool is movable relative to the first section along a longitudinal axis of the downhole tool while the first section is fixed at the location by the extendable anchor. The second section of the downhole tool may include a second extendable anchor to fix the second section to the wall of the wellbore. The first section may be moved (e.g., extended, retracted, etc.) relative to the second section when the extendable anchor of the first section is retracted and while the second extendable anchor fixes the second section to the wall of the wellbore.

While the example downhole tools described herein are described as having two sections and one or two extendable anchors, any other number of additional sections and/or extendable anchors may be used instead. Further, each of the sections may be movable (e.g., extendable, retractable, etc.) relative to the other sections and may include one or more tools or devices to perform wellbore operations such as, for example, sampling operations, testing operations, coring operations, etc. Thus, generally, the one or more tools or devices may include formation evaluation tools and/or reservoir evaluation tools. The movable sections can be moved along a longitudinal axis of the downhole tools precise distances to position precisely one or more tools (e.g., testing tools, sampling tools, coring tools, etc.) coupled to the sections at various depths or locations within a wellbore.

The example downhole tools having movable sections described herein may be conveyed in a wellbore via a wireline, drill string, coiled tubing, and/or in any other manner to perform various operations or sequences of operations at a precisely controlled depth or precisely controlled depths or intervals within the wellbore. More specifically, in some examples, a downhole tool having a movable section may be lowered into a wellbore and a first section of the downhole tool may be anchored or fixed to the wall of the wellbore. A first operation is performed at a location (e.g., depth and/or orientation) in the wellbore. For example, the first operation may involve a formation testing operation such as measuring rock properties. The first operation may be performed by a first tool or device in a second movable section of the downhole tool when the second section is in a retracted condition (i.e., when the second section is not extended away from the first section). The second section of the downhole tool may then be extended (e.g., via a hydraulic device) away from the first section along a longitudinal axis of the downhole tool. The second section may be extended a precisely controlled distance to align another formation testing tool or device (e.g., a fluid testing device) in the second section to substantially the same location of the wall of the wellbore at which the first operation was performed. In this manner, the first and second operations are performed at substantially the same location of the wellbore (e.g., substantially the same wellbore wall location). Thus, the results of the first and second operations may be correlated precisely to each other and to the location within the wellbore.

More generally, the example downhole tools having movable sections described herein may be used to perform a series or sequence of operations (e.g., two or more operations) at a given location within a wellbore. Each of the operations may be a sampling operation (e.g., a formation fluid sampling operation), a testing operation (e.g., temperature and/or pressure measurements), a coring operation, or any other operation that may be performed within a wellbore. Similarly, the example downhole tools described herein may be used to perform a sequence of operations associated with wellbore completion. For example, a first operation may involve drilling a hole in a casing, and subsequent operations may involve injecting cement, plugging the drilled hole, activating completion systems, etc.

The example downhole tools described herein may also be used to perform a single type of operation at multiple, precisely controlled depth intervals or locations within a wellbore. For example, testing operations such as logging operations, gradient measurement operations, imaging operations, and the like may be performed by moving in an incremental manner a section of the example downhole tools described herein and obtaining a measurement (e.g., a temperature, pressure, rock property parameter value, etc.) at each depth or location interval along the wellbore wall.

In some examples, a movable section of the downhole tool may include a portion that is rotatable about the longitudinal axis of the downhole tool. In these examples, the rotatable portion may include a drill to enable drilling of obstructions, reaming of restrictions, etc. within a wellbore. In particular, in the case where the example downhole tool is lowered via a wireline, a first section of the downhole tool may be anchored to the wall of the wellbore and the second section may be forcibly extended into an obstruction in the wellbore while its drill is rotating, thereby enabling a wireline-based drilling operation to be performed. In other examples, the rotatable portion of the second section may include one or more sensors (e.g., temperature, pressure, and/or image sensors) that can be used to obtain circumferential measurements and/or to perform one or more operations about a circumference or perimeter of the wellbore at a given depth or location.

In still other examples, the downhole tool may use its extendable anchors and one or more movable sections to move or walk the downhole tool through the wellbore. Moving a downhole tool in this manner is particularly advantageous in substantially horizontal or deviated sections of the wellbore that would otherwise inhibit or prevent, for example, a downhole tool deployed via a wireline from moving in the wellbore. In particular, a first extendable anchor associated with a first section of the downhole tool may be extended to fix the first section of the downhole tool relative to the wall of the wellbore. A second section may then be moved (e.g., extended) along the longitudinal axis of the downhole tool away from the first section (e.g., deeper into the wellbore). An extendable anchor coupled to the second section may then be extended to fix the second section relative to the wall of the wellbore. The first extendable anchor is then retracted and the first section is moved (e.g., retracted) toward the second section. The first extendable anchor is then extended again to fix the first section relative to its new, deeper location along the wellbore wall and the second extendable anchor may then be retracted to enable the foregoing process to be repeated until the downhole tool has moved a desired distance within the wellbore.

FIG. 1A illustrates an example drilling rig 10 and a drill string 12 in which the example apparatus and methods described herein can be used to, for example, draw formation fluid samples from and/or perform other operations in connection with a subsurface formation F. In the illustrated example, a land-based platform and derrick assembly 10 are positioned over a wellbore 106 penetrating the subsurface formation F. In the illustrated example, the wellbore 106 is formed by rotary drilling in a manner that is well known. Those of ordinary skill in the art given the benefit of this disclosure will appreciate, however, that the apparatus and methods described herein also find application in directional drilling applications as well as rotary drilling, and is not limited to land-based rigs. Further, while the wellbore 106 is depicted as being an uncased hole, the example apparatus and methods described herein may also be used in connection with cased holes.

As shown in FIG. 1A, the drill string 12 is suspended within the wellbore 106 and includes a drill bit 15 at its lower end. The drill string 12 is rotated by a rotary table 16, which engages a kelly 17 at an upper end of the drill string 12. The drill string 12 is suspended from a hook 18, attached to a traveling block (not shown) through the kelly 17 and a rotary swivel 19, which permits rotation of the drill string 12 relative to the hook 18.

A drilling fluid or mud 26 is stored in a pit 27 formed at the well site. A pump 29 is provided to deliver the drilling fluid 26 to the interior of the drill string 12 via a port (not shown) in the swivel 19, inducing the drilling fluid 26 to flow downwardly through the drill string 12 in a direction generally indicated by arrow 9. The drilling fluid 26 exits the drill string 12 via ports (not shown) in the drill bit 15, and then the drilling fluid 26 circulates upwardly through an annulus 28 between the outside of the drill string 12 and the wall of the wellbore 106 in a direction generally indicated by arrows 32. In this manner, the drilling fluid 26 lubricates the drill bit 15 and carries formation cuttings up to the surface as it is returned to the pit 27 for recirculation.

The drill string 12 further includes a bottom hole assembly 5, near the drill bit 15 (e.g., within several drill collar lengths from the drill bit 15). The bottom hole assembly 5 includes drill collars to measure, process, and store information. The bottom hole assembly 5 also includes a surface/local communications subassembly 40 to exchange information with surface systems.

Figure 1B:
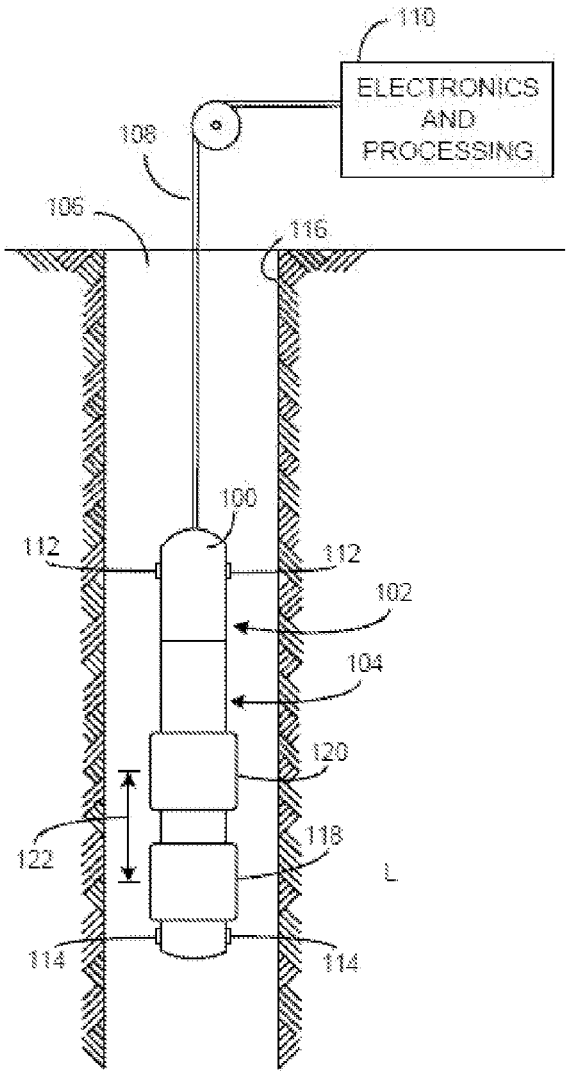
FIGS. 1B-5 depict an example downhole tool having a movable section to perform multiple operations at a given location or depth in a wellbore.

FIGS. 1B-5 depict an example sequence of operations performed by an example downhole tool 100 having a first section 102 and a second section 104. As depicted in FIG. 1, the example bottom hole assembly or downhole or tool 100 is lowered in the wellbore 106 via a wireline 108. The wireline 108 may include multiple electrical wires, cables, etc. to convey electrical signals (e.g., communication signals, control signals, power signals, etc.) between the downhole tool 100 an electronics and processing unit 110 at the surface adjacent the wellbore 106. The wireline 108 may also include one or more cables to provide strength to the wireline 108 to support the weight of the downhole tool 100 as it is raised, lowered, and suspended in the wellbore 106.

Figure 19:
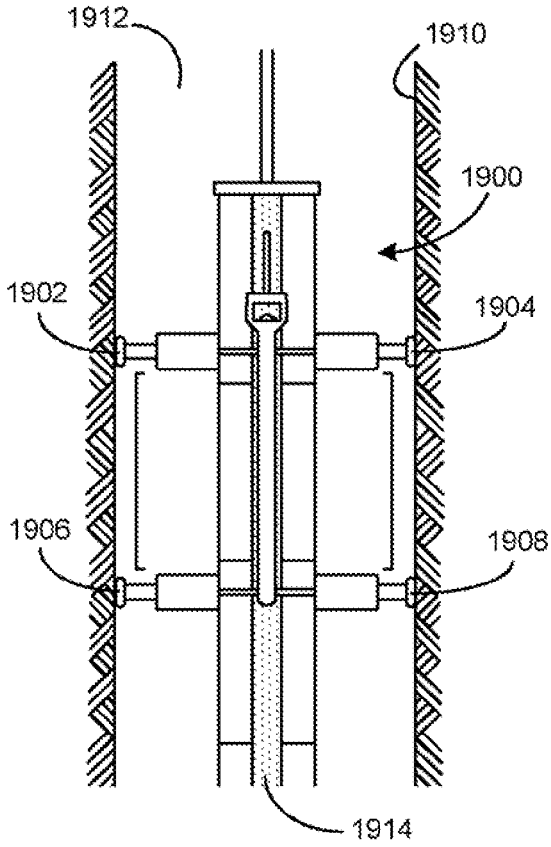
FIGS. 18 and 19 depict example anchoring systems that may be used with the example downhole tools described herein.

The example downhole tool 100 also includes a first extendable anchor or member 112 that is integral with the first section 102, and a second extendable anchor or member 114 that is integral with the second section 104. Each of the extendable anchors 112 and 114 can be selectively extended away or outwardly from the downhole tool 100 to contact or engage a wall 116 of the wellbore 106 to anchor or fix the position of its respective one of the sections 102 and 104 of the downhole tool 100 relative to the wall 116 of the wellbore 106. In other words, the first extendable anchor 112 may be extended to contact the wall 116 to fix the position of the first section 102 relative to the wall 116 of the wellbore 106. Similarly, the second extendable anchor 114 may be extended to contact the wall of the wellbore 106 to fix the second section 104 relative to the wall 116 of the wellbore 106. The extendable anchors or members 112 and 114 may be implemented using a hydraulically operated piston, a spring, a motor, a gear, or in any other manner. In the case where the extendable anchors or members 112 and 114 are implemented using hydraulically operated pistons (as shown in the example of FIG. 19), the extendable anchors or members 112 and 114 may be implemented in a manner similar to the MDT anchoring systems provided by Schlumberger, Inc. Further, while two extendable anchors or members 112 and 114 are shown in FIGS. 1B-5, more than two such extendable anchors or members may be distributed radially about the downhole tool 100.

The second section 104 of the example downhole tool 100 also includes a first device or tool 118 and a second device or tool 120 spaced apart a distance 122 along the longitudinal axis of the downhole tool 100 from the first tool 118. Each of the tools 118 and 120 may be configured to perform one or more wellbore operations such as, for example, testing operations, sampling operations, coring operations, etc. One example coring tool is described in U.S. Pat. No. 6,729,416, which is hereby incorporated by reference in its entirety. In particular, FIGS. 1 and 2 of this patent show an example coring tool in relation to a downhole tool and a formation from which a core sample is to be obtained. One example sampling tool is described in U.S. Pat. No. 7,195,063, which is hereby incorporated by reference in its entirety. In particular, FIGS. 1 and 2 of this patent show an example sampling tool in relation to a downhole tool and a formation from which a fluid sample is to be obtained.

In some examples, the tools 118 and 120 perform different but complementary operations to perform a sequence of operations at a particular location along the wall 116 of the wellbore 106. For example, the first tool 118 may be configured to perform a testing operation such as measuring a temperature or a pressure and the second tool 120 may be configured to perform a sampling operation such as extracting formation fluid from a formation.

In another example, the tools 118 and 120 may perform a sequence or series of completion operations. For example the first tool 118 may use a coring device to remove a damaged area or zone within the wellbore 106 and the second tool 120 may be used to obtain a sample, a pressure measurement, etc. from an undamaged area left by removal of the damaged area by the first tool 118. In yet another example, the first tool 118 may be used to drill a hole in a casing (not shown) of the wellbore 106 and the second tool 120 may be used to inject cement, plug the hole, activate completion systems, etc., thereby enabling the tools 118 and 120 to be used to accomplish a sequence or series of completion operations at substantially the same location within the wellbore 106. In yet another example, the first tool 118 may perform a testing operation such as measuring rock properties and the second tool 120 may perform a testing operation such as measuring fluid properties.

Figure 1C:
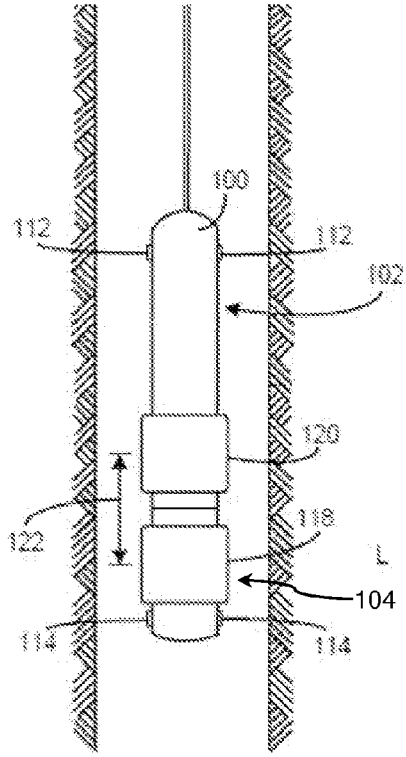

While the example downhole tool 100 depicts the first and second tools 118 and 120 as coupled to the second section 104 so that both of the tools 118 and 120 move together when the second section 104 moves relative to the first section 102, one or both of the tools 118 and 120 may instead be coupled to the first section 102, as shown in FIG. 1C. In the case where one of the tools 118 is coupled to the first section 102 and the other one of the tools is coupled to the second section 104, movement of the second section 104 relative to the first section 102 causes the tools 118 and 120 to move away from or toward one another rather than together as in the case of the example tool 100 of FIG. 1B. Further, while two tools are depicted with the example tool 100 of FIG. 1B, any number of tools arranged in any manner on any number of movable sections could be used instead.

The electronics and processing unit 110 may include one or more processors, memory devices, communications circuitry, power circuitry, etc. to control the operations of the downhole tool 100. In particular, as described in greater detail below, the electronics and processing unit 110 may send control signals to the downhole tool 100 to cause the first extendable anchor 112 to extend to contact the wall 116 of the wellbore 106 and to cause the second section 104 to extend away from and retract toward the first section 102 along the longitudinal axis of the downhole tool 100 when the first section is fixed relative to the wall 116 of the wellbore 106 by the extended anchor 112. Similarly, the electronics and processing unit 110 may cause the second anchor 114 to extend to contact the wall 116, thereby fixing the second section 104 relative to the wall 116. With the second section 104 fixed in position relative to the wall 116 and the first anchor 112 retracted, the electronics and processing unit 110 may cause the first section 102 to extend away from or retract toward the second section 104 along the longitudinal axis of the downhole tool 100.

In some examples, the electronics and processing unit 110 may operate in an open-loop manner in which operator involvement is needed to properly sequence the operations of the downhole tool 100. In particular, in such an open-loop control, operator involvement may be needed to extend and/or retract the extendable anchors 112 and/or 114, operate, the tools 118 and 120, and/or cause the second section 104 to move relative to the first section 102. Alternatively, the electronics and processing unit 110 may operate in a closed-loop manner in which no, or substantially no, operator involvement is needed to control and sequence the operations of the downhole tool 100. In such a closed-loop control, the example downhole tool 100 may operate in a fully automated manner in which the anchors 112 and/or 114 extend and/or retract automatically, the tools 118 and 120 operate automatically and at the proper time, and the second section 104 moves relative to the first section 102 in an automatic manner.

In operation, the downhole tool 100 is lowered via the wireline 108 into the wellbore 106 to a desired depth. The desired depth or location within the wellbore 106 may correspond to a depth at which the first tool or device 118 is aligned with or adjacent to a location "L" as depicted in FIG. 1. The downhole tool 100 may be lowered to the desired depth or location using a flagging technique and/or any correlation technique such as, for example, gamma ray, spontaneous potential, etc.

Figure 2:
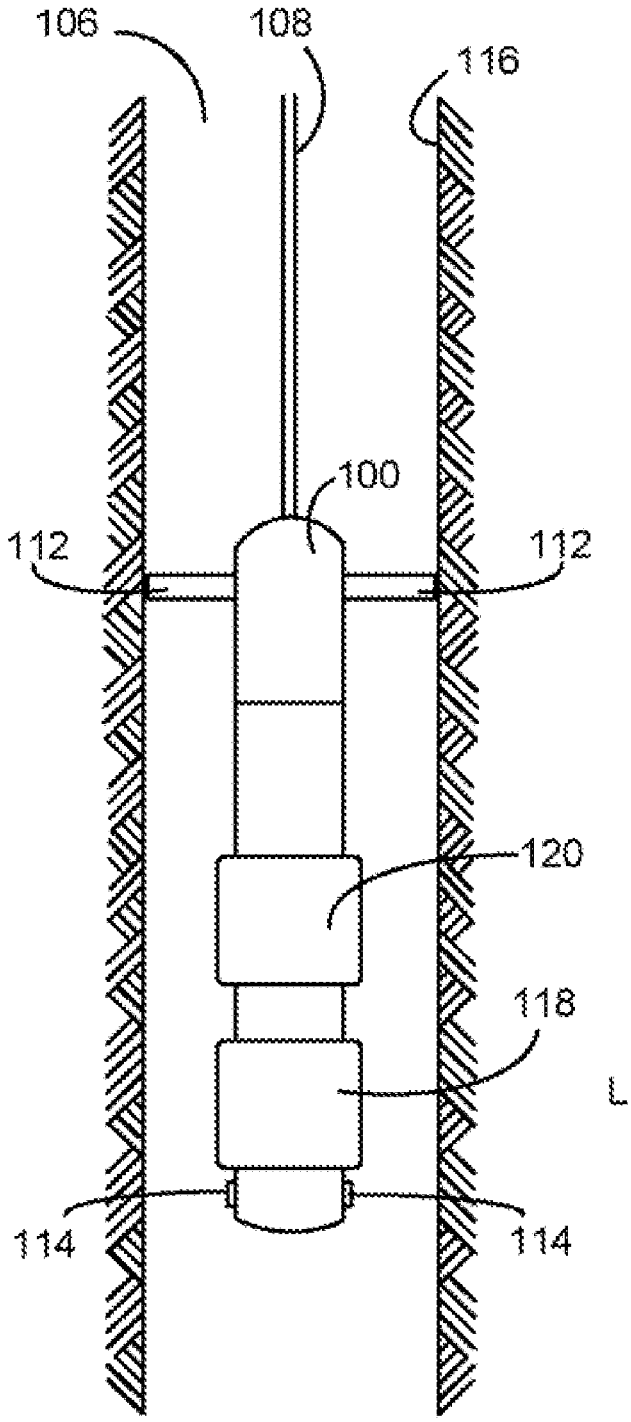

As depicted in FIG. 2, once the downhole tool 100 has been run-in or lowered to the desired depth, the first extendable anchor 112 may be extended to contact the wall 116 of the wellbore 106 to fix or anchor the downhole fool 100 relative to the wall 116 of the wellbore 106. Thus, as shown in FIG. 2, the first tool or device 118 is fixed in a location or at a depth at which the tool or device 118 is substantially aligned to the location L, which may, for example, be associated with a formation to be tested, sampled, etc.

Figure 3:
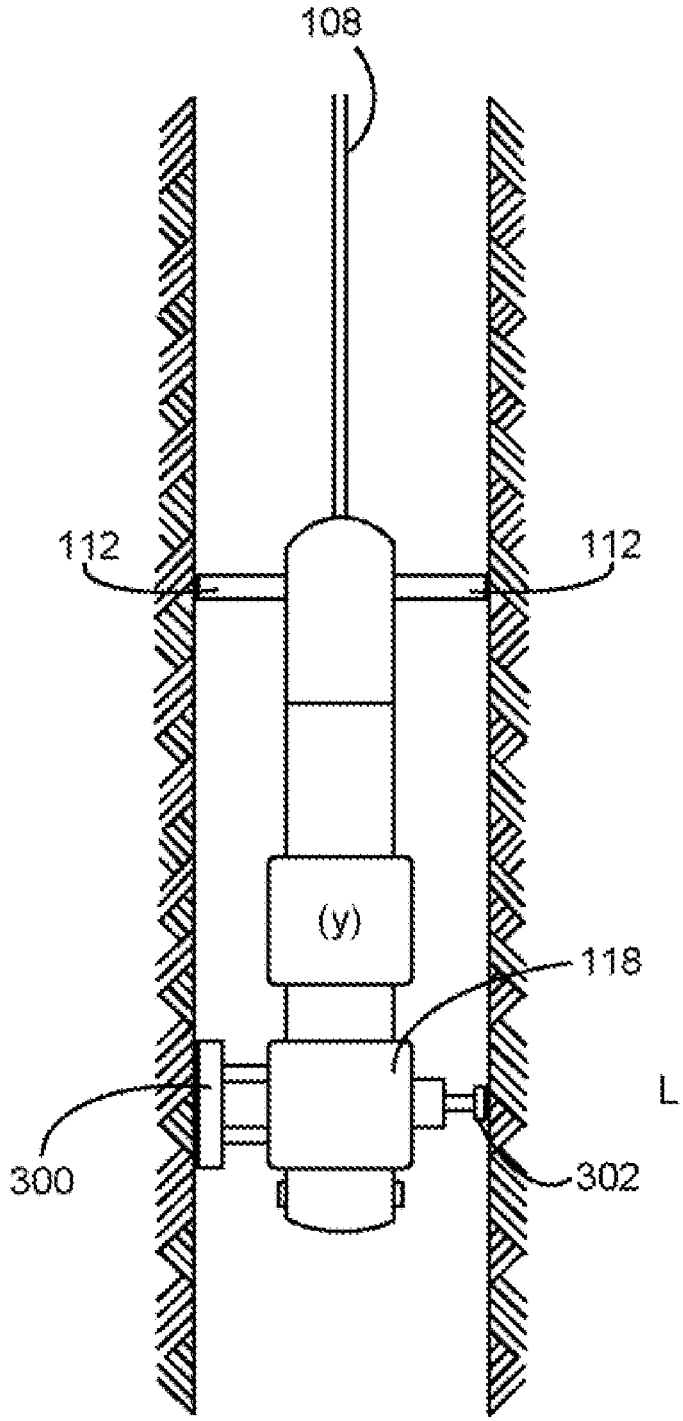

Then, as depicted in FIG. 3, a foot or anchor 300 may be extended from the tool 118 and a sampling probe, sensor, coring device, fluid injection device, etc. 302 may be extended to as shown to contact the wall 116 adjacent the location L. The anchor 300 and the probe, sensor, coring device, fluid injection device, etc. may be extended and retracted using hydraulic pistons or the like in known manners. Regardless of the particular configuration or type of tool(s) or device(s) used to implement the first tool 118, the probe, sensor, coring device, fluid injector, etc. 302 performs its operation(s) at the wall 116 adjacent the location L. For example, in the case where the first tool 118 includes a pressure sensing head or unit 302, a pressure reading may be obtained and conveyed via the wireline 108 to the electronics and processing unit 110.

Figure 4:
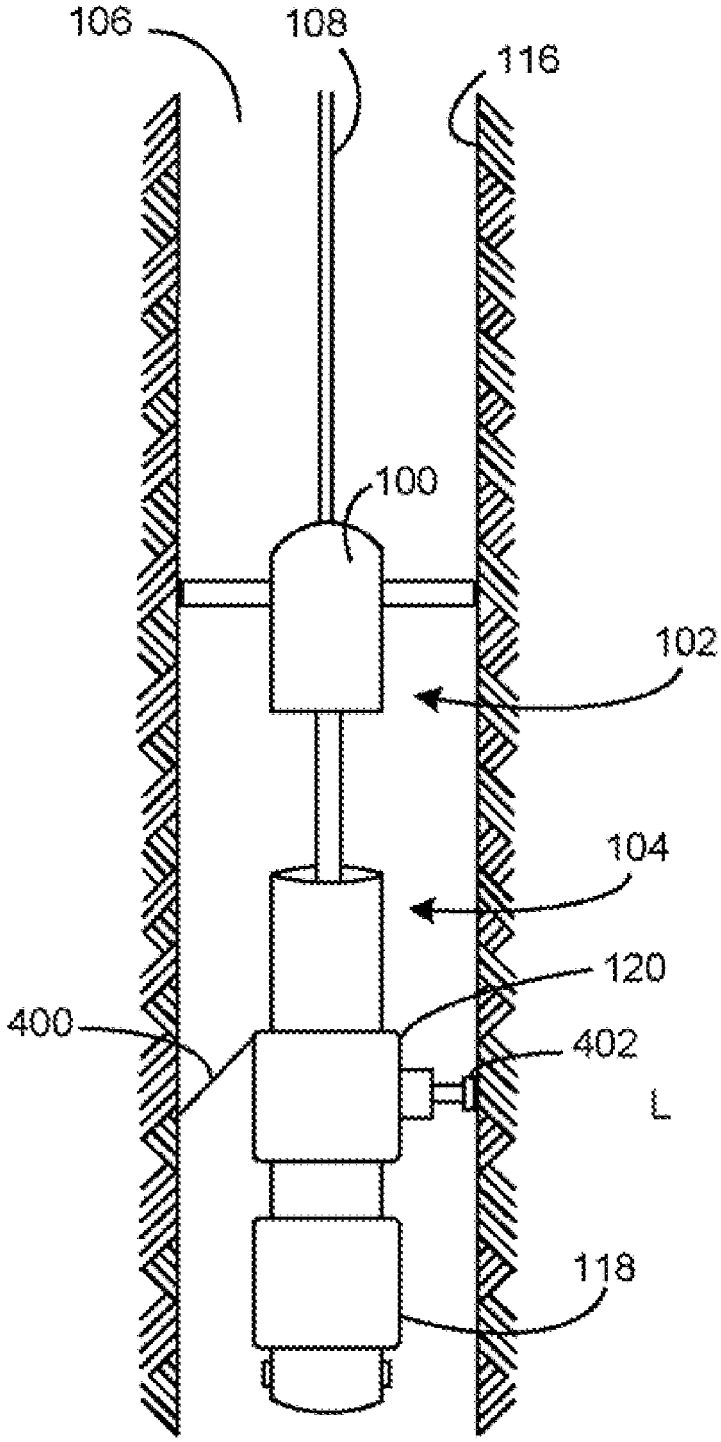

As depicted in FIG. 4, after the first tool 118 has completed performance of its operation(s) at the location L, the anchor 300 and the sensor, sampling device, coring device, fluid injector, etc. 302 are retracted, and the second section 104 of the downhole tool 100 is extended away from the first section 102 along the longitudinal axis of the downhole tool 100. As shown in FIG. 4, the second section 104 has been extended a distance that is substantially equal to the distance 122 (FIG. 1) between the tools or device 118 and 120 so that the second tool or device 120 is at a depth to substantially align the second tool 120 with the location L (i.e., the location at which the first tool 118 was previously positioned). The second section 104 may be extended and retracted using, for example, a hydraulic piston, a bellows, a screw and motor assembly, and/or any other suitable mechanism(s). Examples of such mechanisms are described in greater detail below in connection with FIGS. 15 and 16.

A stabilizer 400 (e.g., a bow spring, an extendable arm or anchor, etc.) may be used to ensure that a sensor, probe, coring device, etc. 402 remains in contact with the wall 116 adjacent the location L. Thus, in this manner, the second tool 120 may perform its operation(s) at substantially the same location at which the first tool 118 performed its operations(s) without having to attempt to adjust the location of the downhole tool 100 by changing the deployed length of the wireline 108 in the wellbore 106 based on, for example, wireline flagging, and/or a correlation technique such as gamma ray correlation.

Figure 5:
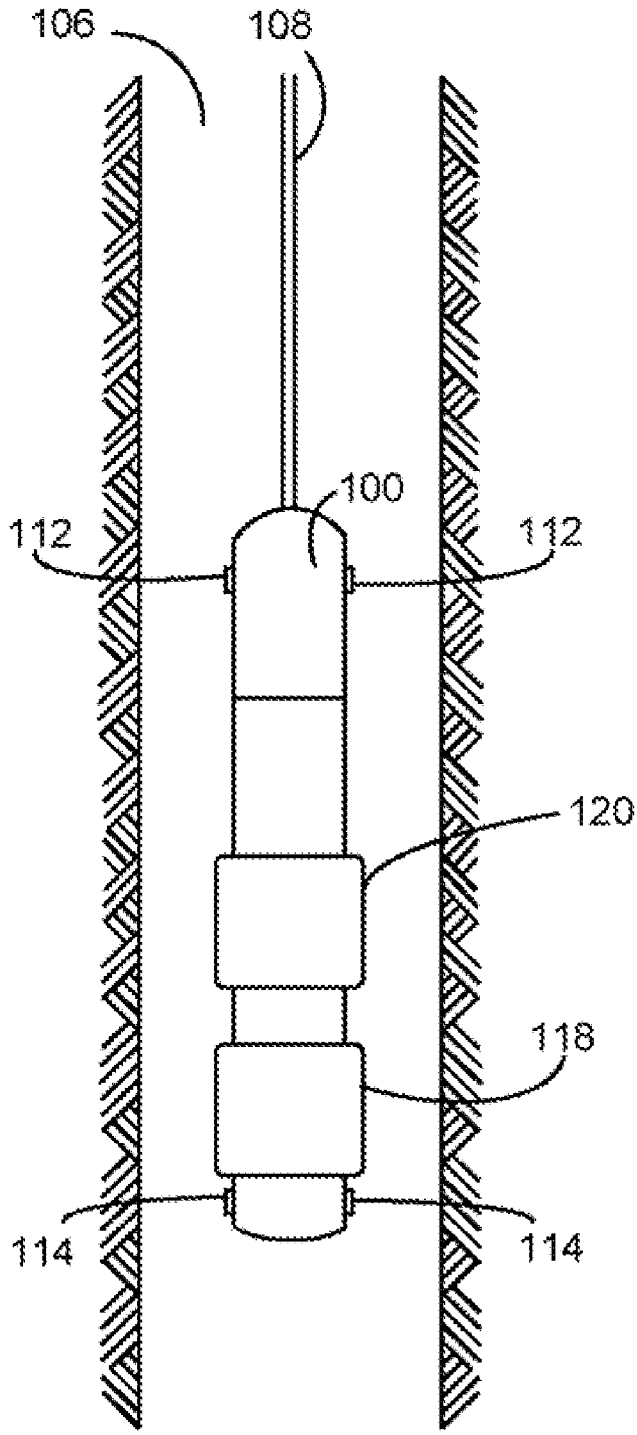

As depicted in FIG. 5, when the second tool 120 has completed its operation(s) at the location L, the stabilizer 400 and the sampling probe, testing device, coring device, etc. 402 of the second tool 120 are retracted, and the first extendable anchor 112 is retracted, leaving the downhole tool 100 unanchored or free to move. The downhole tool 100 may then be moved to a new location within the wellbore 106 and/or removed or recovered from the wellbore 106 to the surface together with any samples (e.g., fluid samples, cores, etc.) collected by the operations performed by the tools 118 and 120.

Figure 6:
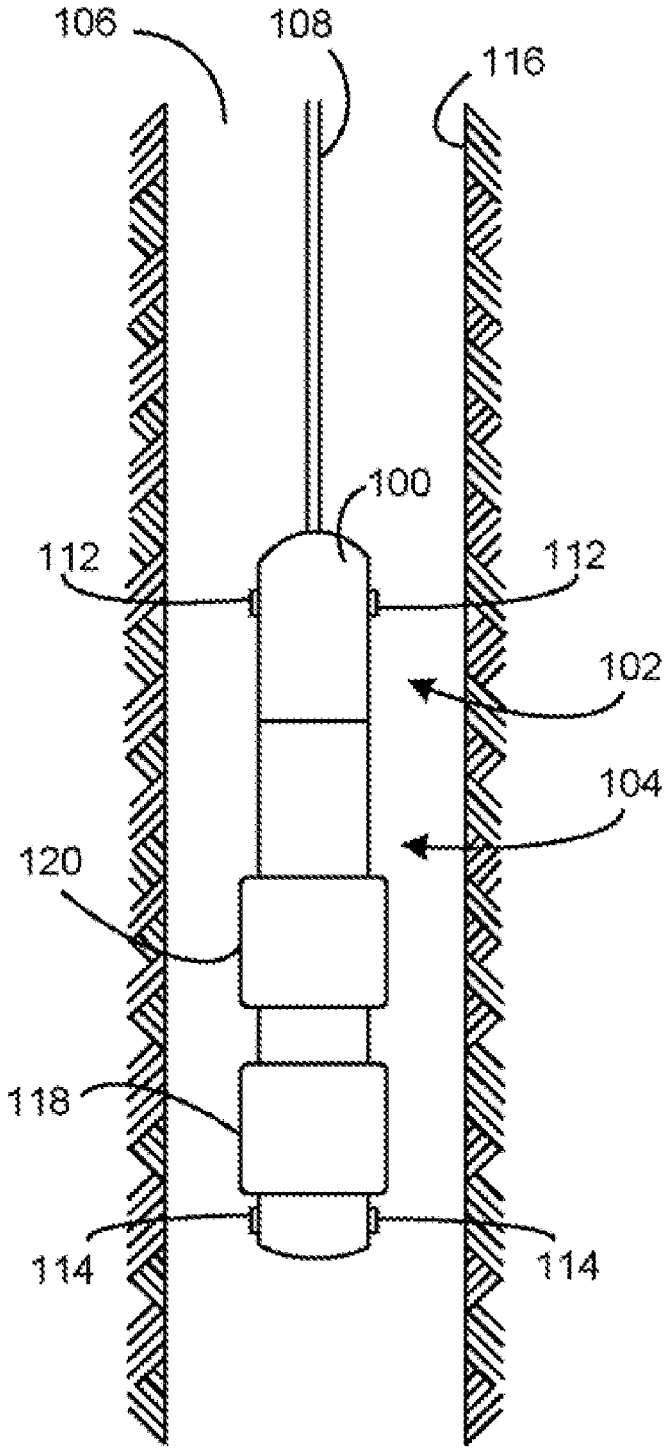
FIGS. 6-8 depict another manner in which the example downhole tool of FIGS. 1-5 may be used to achieve greater movements within a wellbore via multiple anchoring/un-anchoring and extension/retraction cycles of the movable section.
Figure 7:
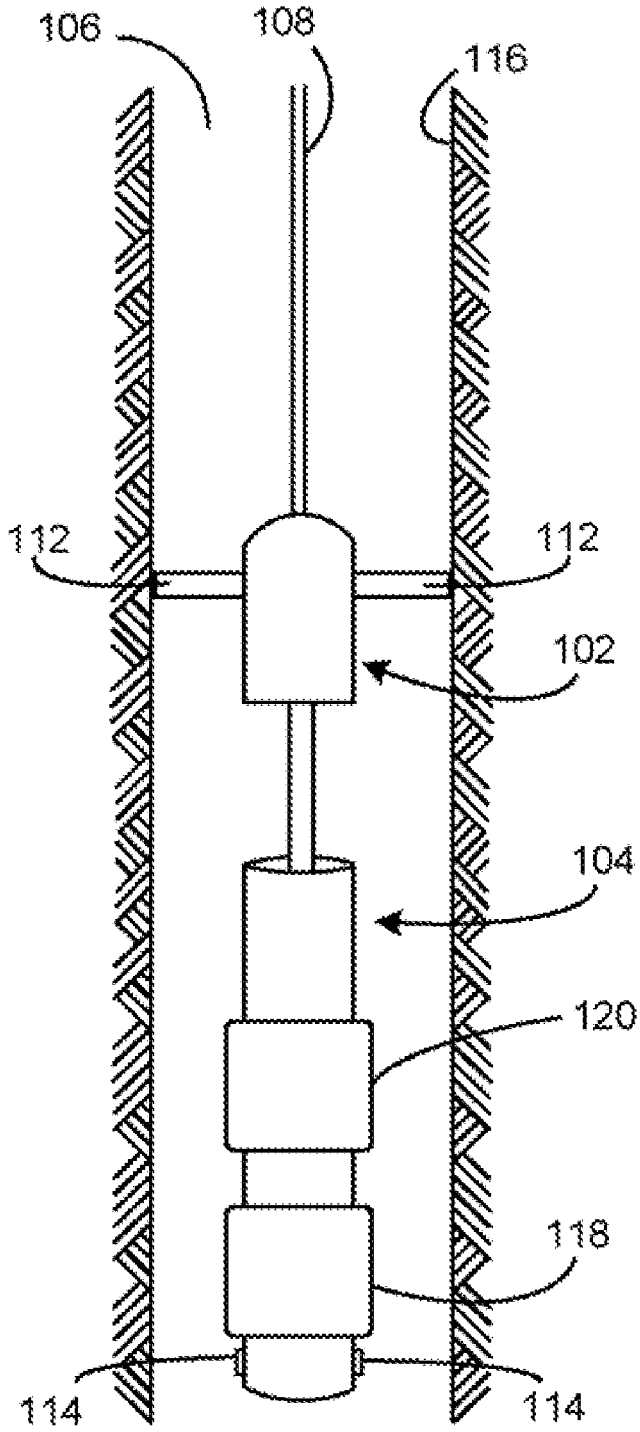
Figure 8:
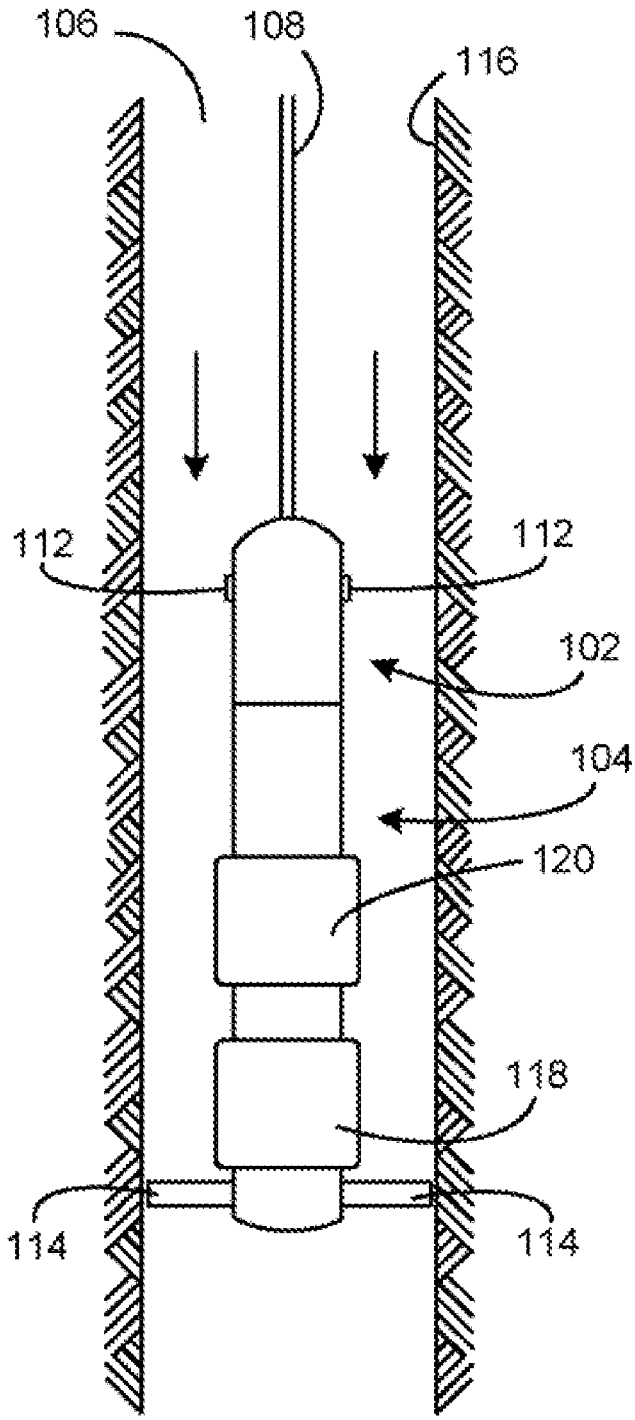

FIGS. 6-8 depict another manner in which the example downhole tool 100 may be used within the wellbore 106 to achieve greater movements or displacements within the wellbore 106 via multiple anchoring/un-anchoring and extension/retraction cycles of the first and second sections 102 and 104. Initially, as shown in FIG. 6, the example downhole tool 100 is deployed in the wellbore 106 via the wireline 108 to any desired depth. Then, as depicted in FIG. 7, the first extendable anchor 112 is extended to contact the wall 116 to anchor the first section 102 to the wall 116 of the wellbore 106. With the first section 102 anchored, the second section 104 is extended a desired distance away from the first section 102 along the longitudinal axis of the downhole tool 100. Then, as depicted in FIG. 7, the second extendable anchor 114 is extended to contact the wall 116 to anchor or fix the second section 104 relative to the wall 116, the first anchor 112 is retracted, and the first section 102 is retracted toward the second section 104. The foregoing sequence or process may be repeated any number of times to achieve any desired amount of travel or displacement down and into or up and out of the wellbore 106 suitable for a particular operation or series of operations. Further, the example sequence or process described in connection with FIGS. 6-8 may be used to convey the downhole tool 100 in deviated or substantially horizontal wellbores, which may otherwise not permit the conveyance of a wireline deployed downhole tool or any other conventional downhole tool. Still further, as the downhole tool 100 moves within the wellbore 106, one or both of the tools or devices 118 and 120 may be used to collect samples, pressure measurements, cores, etc. along the wall 116 of the wellbore 106. Alternatively or additionally, one or both of the tools or devices 118 and 120 may be used to repeatedly collect data or information at various depths to enable the electronics and processing unit 110 to generate log information (e.g., a parameter versus depth information).

Figure 9:
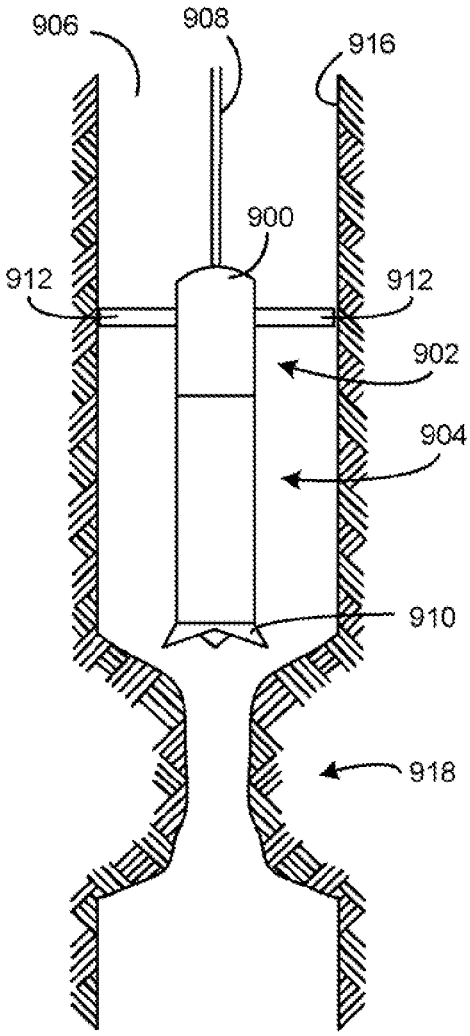
FIGS. 9 and 10 depict another example downhole tool that may be deployed via wireline and which may be used to forcibly drill or ream through ledges or other restrictions in a wellbore.
Figure 10:
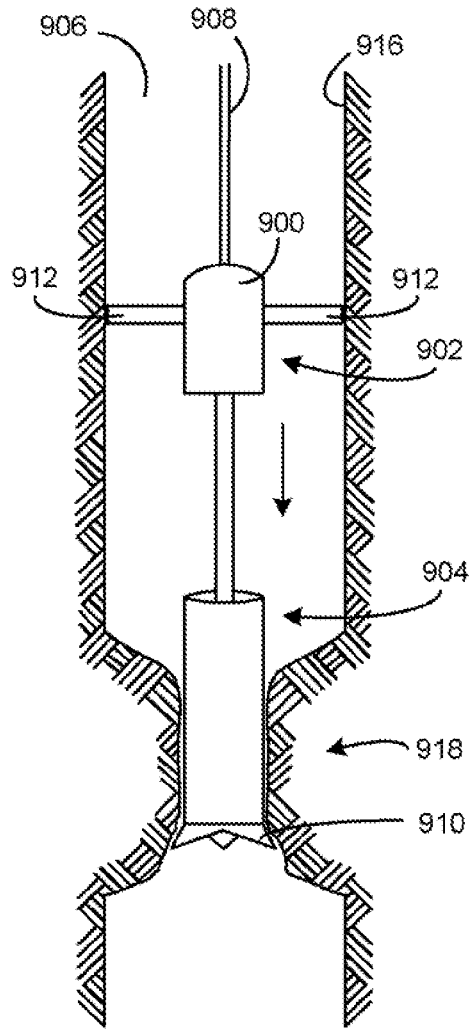

FIGS. 9 and 10 depict another example downhole tool 900 that may be deployed via wireline and which may be used to forcibly drill or ream through ledges or other restrictions in a wellbore. In particular, the example downhole tool 900 includes a first section 902 and a second section 904. The second section 904 includes a rotatable portion that rotates a drill bit 910. In FIG. 9, the example downhole tool 900 is deployed in a Wellbore 906 via a wireline 908. An extendable anchor 912 is extended to contact a wall 916 of the wellbore 906 to fix or anchor the example downhole tool 900 above a restriction 918 in the wellbore 906. As shown in FIG. 10, the second section 904 may be extended away from the first section 902 and toward the restriction 918 to enable the drill bit 910 to forcibly engage the restriction 918 and to enable the restriction 918 to be reamed or enlarged by the drill bit 910. The foregoing process may be repealed any number of times at progressively greater distances or displacements into the wellbore 906. Further, the example downhole tool 900 may also be used to convey tools in a highly deviated wellbore and/or a substantially horizontal, portion of a wellbore. Still further, the example downhole tool 900 may be combined with any number of tools or devices to perform any desired type(s) and number(s) of operations within the wellbore 906.

Figure 13:
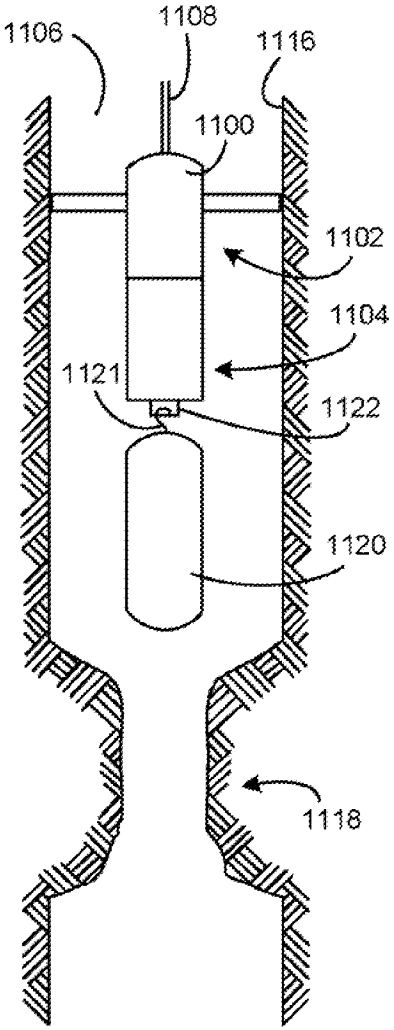
FIGS. 11-13 depict yet another example manner in which an example downhole tool may be used to dislodge and extract or fish out a stuck tool in a wellbore.
Figure 12:
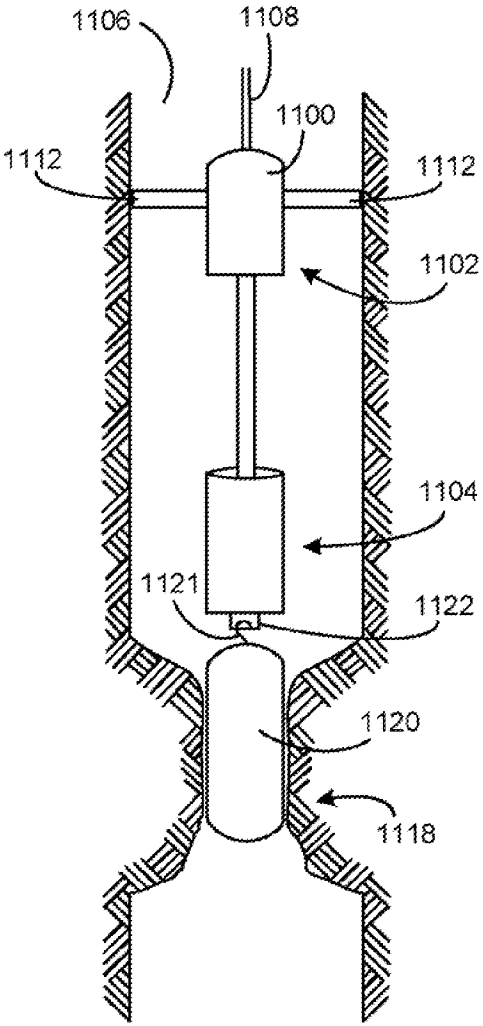
Figure 11:
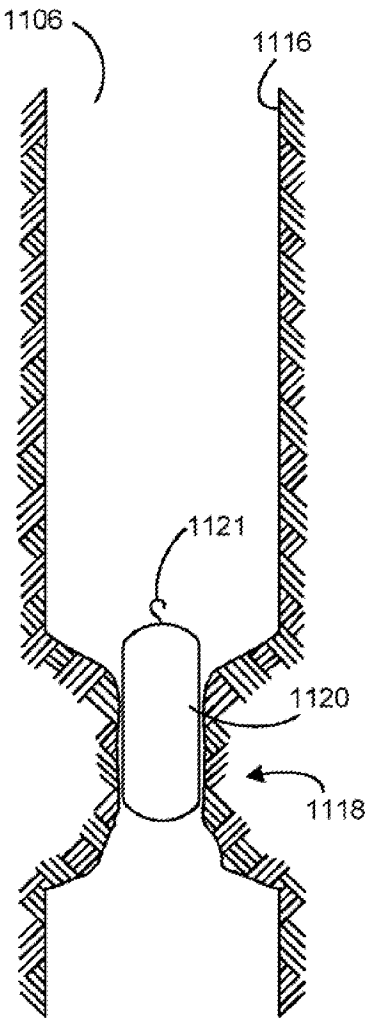

FIGS. 11-13 depict yet another example manner in which an example downhole tool 1100 may be used to dislodge and extract or fish out a stuck tool 1120 from, for example, a restriction 1118 in a wellbore 1106. The stuck tool 1120 includes a hook-type coupling 1121 configured to engage or otherwise couple to a fishing tool or complementary coupling 1122 as described in more detail below. The hook-type coupling 1121 and the fishing tool or complementary coupling 1122 are merely examples and any other type of mechanical couplings may be used instead.

Initially, as shown in FIG. 11, the tool 1120 may be stuck in the restriction 1118 of the wellbore 1106. The example downhole tool 1100 is then lowered into the wellbore 1106 via a wireline 1108. When the example downhole tool 1100 has reached a desired location or depth, an extendable anchor 1112, which may be similar to the extendable anchors described above in connection with the other example downhole tools, is extended to contact a wall 1116 of the wellbore 1106 to fix or anchor a first section 1102 of the downhole tool 1100 to the wall 1116 of the wellbore 1106. A second section 1104 of the downhole tool 1100 is then moved or extended away from the first section 1102 along a longitudinal axis of the downhole tool 1100 and into contact with the stuck tool 1120. The second section 1104 of the downhole tool 1100 includes the fishing tool (e.g., an over shot type tool, or any other type of fishing tool) 1122 that latches the coupling 1121 of the stuck tool 1120 when the fishing tool 1122 is forcibly engaged with the stuck tool 1120. Then, as depicted in FIG. 13, the second section 1104 is retracted toward the first section 1102 to dislodge and remove the stuck tool 1120 from the restriction 1118. In the example of FIGS. 11-13, the stuck tool 1120 and/or the tool 1100 may be equipped (e.g., with tools similar to the tools 118 and 120 of FIG. 1B) to perform additional operations (e.g., logging, sampling, coring, etc.) while fishing out the stuck tool 1120.

Figure 14:
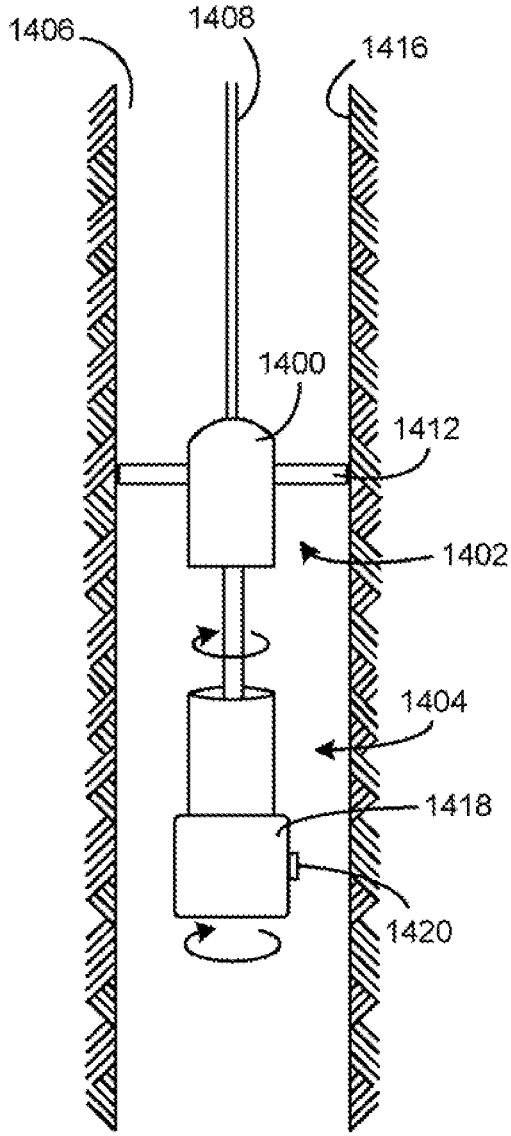
FIG. 14 depicts another example downhole tool having a longitudinally movable and rotatable section.

FIG. 14 depicts another example downhole tool 1400 having a first section 1402 and a second section 1404 that is movable along the longitudinal axis of the example downhole tool 1400 relative to the first section 1402. Additionally, the second section 1404 is rotatable relative to the first section 1402 and about the longitudinal axis of the downhole tool 1400. As shown in FIG. 14, the example downhole tool 1400 may be lowered to a desired depth in a wellbore 1406 and fixed or anchored to a wall 1416 of the wellbore 1406 by extending an anchor 1412 to contact the wall 1416 of the wellbore 1406. The second section 1404 may then be extended a desired distance away from the first section 1402 along the longitudinal axis of the downhole tool 1400. A tool 1418 having a sensor or probe 1420 may then be rotated by rotating the second section 1404 about the longitudinal axis of the downhole tool 1400. The sensor or probe 1420 may be an image sensor, a temperature sensor, a pressure sensor, a sampling probe, or any other sensor, probe, or combination of sensors and/or probes. In this manner, the example downhole tool 1400 may be used to collect information over the circumference of the wall 1416 of the wellbore 1406 at any depth of interest. For example, in the case where the sensor or probe 1420 is an image sensor, the example downhole tool 1400 may be used to make a full imaging log (e.g., a magnetic resonance image, resistivity image, etc.) of the wellbore 1406 at any depth or depths to detect, for example, anomalies (e.g., casing deficiencies, anisotropy, factures, etc.) associated with the wellbore 1406. In the case where the sensor or probe 1420 is a pressure sensor, the rotation of the sensor 1420 enables the performance of vertical interference tests as well as the evaluation of the variation of horizontal permeabilities. The rotational or angular position or orientation of the sensor or probe 1420 may be determined and tracked via, for example, a magnetometer (not shown) or any other similar device coupled to the second section 1404.

Figure 15:
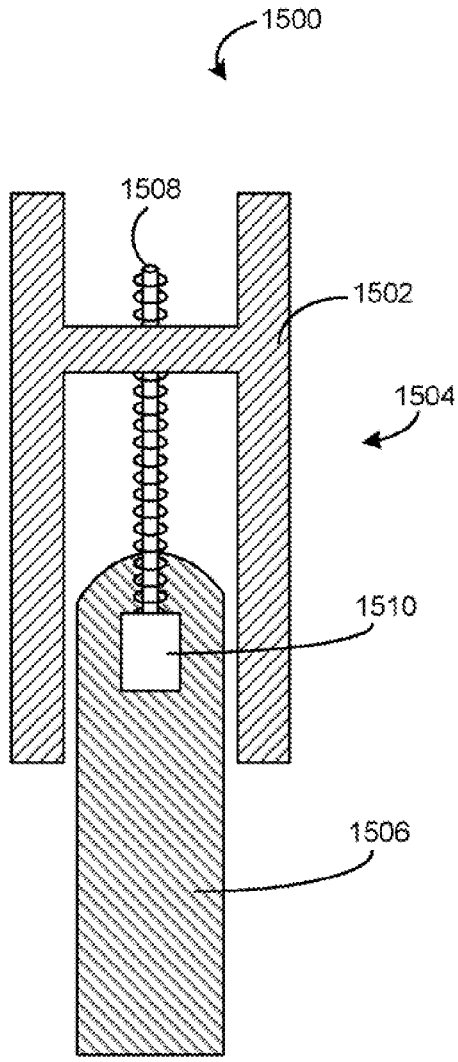

FIG. 15 depicts an example extension/retraction mechanism 1500 that may be used with the example downhole tools described herein to enable one section of a downhole tool to be extended away from and retracted toward another section of the downhole tool along the longitudinal axis of the downhole tool. As shown in FIG. 15, a body or frame portion 1502 of a first section 1504 of a downhole tool (not shown) is coupled to a rod or thrust member 1506, which may be coupled to a second section (not shown), via a screw or threaded shaft 1508. A motor 1510 associated with the rod or thrust member 1506 is rotatably coupled to the screw or threaded shaft 1508, which is also threadingly engaged with the body or frame portion 1502. Thus, when the motor 1510 operates and turns the screw 1508, the rod or thrust member 1506, which is coupled to the second section of the downhole tool, is extended away from or retracted toward the first section 1504.

Figure 16:
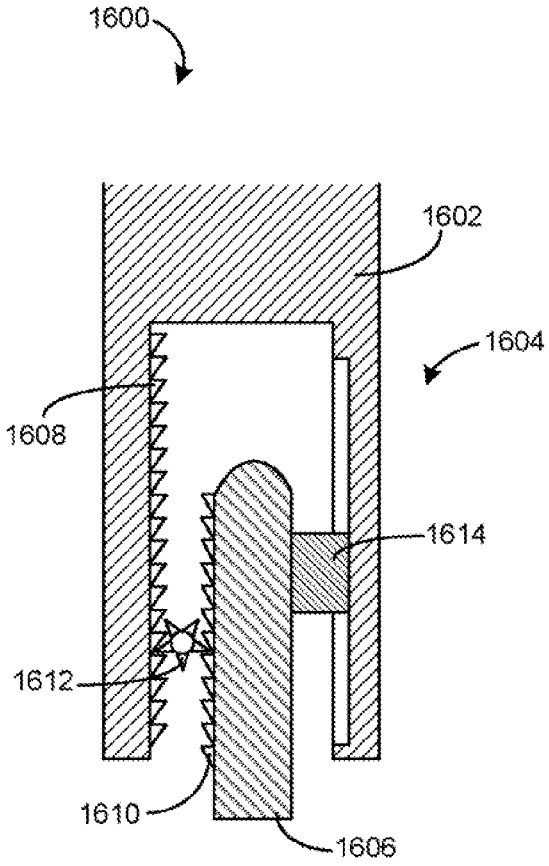
FIGS. 15 and 16 depict example extension/retraction mechanisms that may be used with the example downhole tools described herein.

FIG. 16 depicts another example mechanism 1600 that may be used with the example downhole tools described herein to enable one section of a downhole tool to be extended away from and retracted toward another section of the downhole tool along the longitudinal axis of the downhole tool. As depicted in FIG. 16, the example mechanism 1600 includes a body or Frame portion 1602 associated with a first section 1604 of a downhole tool. The example mechanism 1600 also includes a rod or thrust member 1606, which may be coupled to a second section (not shown) of the downhole tool. The body or frame 1602 and the rod or thrust member 1606 include respective opposing racks of teeth 1608 and 1610, which are mutually coupled to a spur gear 1612. Additionally, the rod or thrust member 1606 is slidingly engaged with the body or frame portion 1602 via a slider mechanism 1614. Thus, when the gear 1612 is rotated (e.g., via a motor which is not shown), the rod or thrust member 1606 may be extended away from or retracted toward the first section 1604. While the gear 1612 is depicted as being engaged between two racks of teeth (i.e., the racks 1608 and 1610), a single rack and gear combination could be used instead to accomplish similar or identical results.

Figure 17:
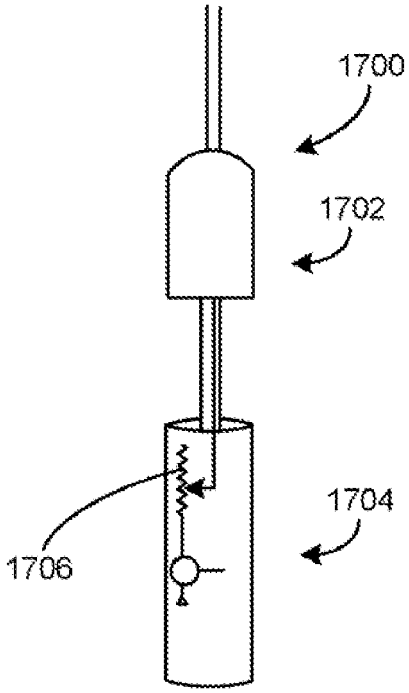
FIG. 17 depicts an example manner in which the example downhole tools described herein may provide a measured linear displacement of one section of the downhole tool relative to another section of the downhole tool.

FIG. 17 depicts an example manner in which a downhole tool 1700 having a first section 1702 and a second section 1704 that is extendable and retractable relative to the first section 1702 may provide a measured linear displacement. In particular, the second section 1704 may include a linear potentiometer 1706 that may be used to accurately determine and control the displacement of the second section 1704 relative to the first section 1702. The resistance value may be transmitted to the surface (e.g., to an electronics and processing unit such as the unit 110 of FIG. 1) to enable the displacement of the second section 1704 to be controlled (e.g., via a feedback control loop or the like). In some examples, the displacement of the second section 1704 may be varied as needed to perform a desired wellbore operation or series of operations. For example, in a logging operation, the potentiometer 1706 may be used to move the second section 1704 in controlled increments or, alternatively, continuously at a certain rate or speed.

Figure 18:
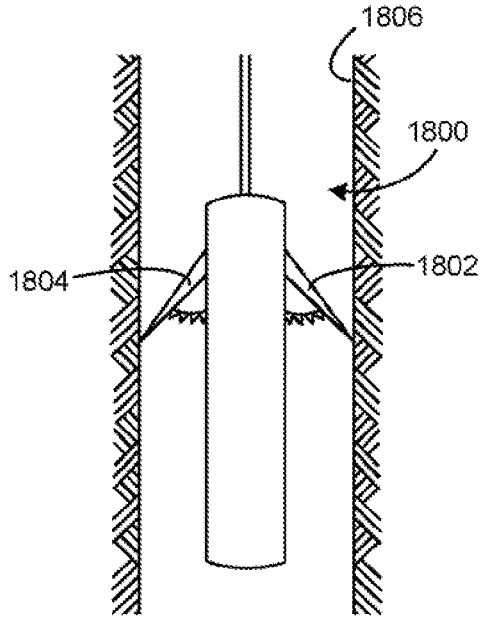

FIG. 18 depicts an example mechanical anchoring mechanism 1800 that may be used to implement the extendable anchors described herein. In particular, the anchoring mechanism 1800 includes arms 1802 and 1804 that may be extended outwardly to engage a wellbore wall 1806. The arms 1802 and 1804 may be extended and/or retracted using springs, endless screw mechanisms, hydraulically, or in any other manner. Further, while two arms (i.e., the arm 1802 and 1804) are shown, any other number of arms may be used instead.

FIG. 19 depicts another example anchoring mechanism 1900 that may be used to implement the extendable anchors described herein. More specifically, the example anchoring mechanism 1900 includes a plurality of hydraulically operated pistons 1902, 1904, 1906, and 1908, which may be extended outwardly to engage a wall 1910 of a wellbore 1912. Oil or other fluid 1914 may be pumped under pressure to drive the pistons 1902, 1904, 1906, and 1908 outwardly to engage the wall 1910 with a desired set pressure.

The foregoing example downhole tools having one or more movable sections may also include one or more force sensors to measure or detect the force used to move one section relative to another section. Measuring, for example, the extension force and/or retraction force facilitates avoidance of damage to tools and/or the conveyance system (e.g., wireline, coiled tubing, etc.) used to deploy the example downhole tools described herein. Further, the example downhole tools described herein may employ one or more magnetometers to determine orientation of one or more tools or devices composing the example downhole tools. Additionally, the example anchoring mechanisms described herein in connection with the example downhole tools may employ force and/or displacement sensors to measure rock strength to better control the setting pressure applied by the anchoring mechanisms.

Although certain example methods and apparatus have been described herein, the scope of coverage of this patent is not limited thereto. On the contrary, this patent covers all apparatus and articles of manufacture fairly falling within the scope of the appended claims either literally or under the doctrine of equivalents.

What is claimed is:

1. A method, comprising:

conveying a downhole tool via wireline in a wellbore extending into a subterranean formation;

anchoring the downhole tool in the wellbore by extending an anchor from the downhole tool into contact with a wall of the wellbore at a first location in the wellbore;

performing a formation fluid sampling operation using a sampling tool associated with a first section, wherein the sampling operation is performed at a second location in the wellbore while the downhole tool remains anchored in the wellbore at the first location, and wherein the second location is spaced apart from the first location in a direction parallel to a longitudinal axis of the downhole tool; and moving the first section of the downhole tool and a second section of the downhole tool such that the first section of the downhole tool translates away from the second location in a direction parallel to the longitudinal axis of the downhole tool and the second section of the downhole tool translates to the second location in a direction parallel to the longitudinal axis of the downhole tool, and then performing a coring operation at the second location using a coring tool associated with the second section.

2. The method of claim 1 further comprising performing a testing operation using at least a portion of the downhole tool positioned at the second location.

3. The method of claim 1 further comprising performing a gradient measurement operation using at least a portion of the downhole tool positioned at the second location.

4. The method of claim 2 further comprising performing a gradient measurement operation using at least a portion of the downhole tool positioned at the second location.

5. The method of claim 1 further comprising performing an imaging operation using at least a portion of the downhole tool positioned at the second location.

6. The method of claim 2 further comprising performing an imaging operation using at least a portion of the downhole tool positioned at the second location.

7. The method of claim 3 further comprising performing an imaging operation using at least a portion of the downhole tool positioned at the second location.

8. The method of claim 4 further comprising performing an imaging operation using at least a portion of the downhole tool positioned at the second location.

9. A method, comprising:

conveying a downhole tool via a drill string in a wellbore extending into a subterranean formation;

anchoring the downhole tool in the wellbore by extending an anchor from the downhole tool into contact with a wall of the wellbore at a first location in the wellbore;

performing a formation fluid sampling operation using a sampling tool associated with a first section, wherein the sampling operation is performed at a second location in the wellbore while the downhole tool remains anchored in the wellbore at the first location, and wherein the second location is spaced apart from the first location in a direction parallel to a longitudinal axis of the downhole tool; and moving the first section of the downhole tool and a second section of the downhole tool such that the first section of the downhole tool translates away from the second location in a direction parallel to the longitudinal axis of the downhole tool and the second section of the downhole tool translates to the second location in a direction parallel to the longitudinal axis of the downhole tool, and then performing a coring operation at the second location using a coring tool associated with the second section.

10. The method of claim 9 further comprising performing a testing operation using at least a portion of the downhole tool positioned at the second location.

11. The method of claim 9 further comprising performing a gradient measurement operation using at least a portion of the downhole tool positioned at the second location.

12. The method of claim 10 further comprising performing a gradient measurement operation using at least a portion of the downhole tool positioned at the second location.

13. The method of claim 9 further comprising performing an imaging operation using at least a portion of the downhole tool positioned at the second location.

14. The method of claim 10 further comprising performing an imaging operation using at least a portion of the downhole tool positioned at the second location.

15. The method of claim 11 further comprising performing an imaging operation using at least a portion of the downhole tool positioned at the second location.

16. The method of claim 12 further comprising performing an imaging operation using at least a portion of the downhole tool positioned at the second location.

* * * * *